US006623568B2

(12) United States Patent
Hirose et al.

(10) Patent No.: US 6,623,568 B2
(45) Date of Patent: Sep. 23, 2003

(54) TI ALLOY POPPET VALVE AND A METHOD OF MANUFACTURING THE SAME

(75) Inventors: Masahito Hirose, Hayama-machi (JP); Hiroaki Asanuma, Fujisawa (JP)

(73) Assignee: Fuji Oozx Inc., Kanagawa-Ken (JP)

( * ) Notice: Subject to any disclaimer, the term of this patent is extended or adjusted under 35 U.S.C. 154(b) by 0 days.

(21) Appl. No.: 10/274,727

(22) Filed: Oct. 21, 2002

(65) Prior Publication Data

US 2003/0056856 A1 Mar. 27, 2003

Related U.S. Application Data

(62) Division of application No. 09/791,308, filed on Feb. 22, 2001, now Pat. No. 6,511,045.

(30) Foreign Application Priority Data

Jul. 18, 2000 (JP) ..... 2000-217507
Feb. 1, 2001 (JP) ..... 2001-25415

(51) Int. Cl.[7] ..... C23C 8/00; C23C 8/20
(52) U.S. Cl. ..... 148/237; 148/669
(58) Field of Search ..... 148/237, 669, 148/670, 671; 251/368; 123/188.3

(56) References Cited

U.S. PATENT DOCUMENTS

| | | | | |
|---|---|---|---|---|
| 5,370,364 | A | 12/1994 | Kenmoku et al. | |
| 5,441,235 | A | 8/1995 | Narasimhan et al. | |
| 5,466,305 | A | 11/1995 | Sato et al. | |
| 5,517,956 | A | 5/1996 | Jette et al. | |
| 5,662,745 | A | 9/1997 | Takayama et al. | |
| 6,131,603 | A * | 10/2000 | Takano et al. | 137/375 |

FOREIGN PATENT DOCUMENTS

| | | |
|---|---|---|
| EP | 1174593 A2 * | 1/2002 |
| JP | P3022015 | 1/2000 |

* cited by examiner

*Primary Examiner*—John Sheehan
(74) *Attorney, Agent, or Firm*—Fulwider Patton Utecht & Lee, LLP

(57) ABSTRACT

A Ti alloy poppet valve consists of a valve stem and a valve head, and is employed as intake or exhaust valve in an internal combustion engine of an automobile. $O_2$ is put into the valve in a furnace at very slight amount and heated to introduce oxygen atoms into titanium of the valve to form a Ti—O interstitial solid solution without making titanium oxides. The valve is strengthened to increase hardness and wear resistance.

8 Claims, 6 Drawing Sheets

TI ALLOY POPPET VALVE AND A METHOD OF MANUFACTURING THE SAME

RELATED APPLICATIONS

This is a divisional application based upon Ser. No. 09/791,308, filed Feb. 22, 2001, now U.S. Pat. No. 6,511,045.

BACKGROUND OF THE INVENTION

The present invention relates to a Ti alloy poppet valve and a method of manufacturing the same.

To decrease inertial mass to improve engine performance, intake and exhaust valves in an internal combustion engine are made of Ti alloy instead of heat resistant steel. But Ti is likely to be combined with another element such as oxygen and wear resistance is not sufficient.

On the surface of Ti alloy poppet valve, nitriding and oxidizing as disclosed in Japanese Patent No. 3,022,015, carburizing as disclosed in U.S. Pat. No. 5,466,305 or Ni plating is applied to increase wear resistance.

A valve to which nitriding or oxidizing is applied provides sufficient wear resistance, but has too high hardness, so that it is likely to attack other members. It is necessary to change material of the valve-operating part which is engaged with the valve, so that cost increases.

During oxidizing, a workpiece is placed at high temperature, 750 to 800° C. in atmosphere to which air or oxygen is supplied, so that diffusion of oxygen is too fast, thereby forming hard fragile oxide layer such as $TiO_2$ and $Ti_2O_3$, which is likely to be separated.

It is difficult to attain sufficient wear resistance by carburizing on the surface of the valve. In a valve to which Ni plating is applied, heat resistance is not sufficient and it is not suitable to employ it as exhaust valve.

SUMMARY OF THE INVENTION

In view of the disadvantages as above, it is an object of the invention to provide a Ti alloy poppet valve in which wear resistance is significantly increased without forming titanium oxide It is another object of the invention to provide a method of manufacturing a Ti poppet alloy valve in which wear resistance is significantly increased.

According to one aspect of the invention, there is provided a Ti alloy poppet valve which consists of a valve stem and a valve head, said valve having a surface layer which comprises an oxygen diffusion layer of an interstitial solid solution of O in Ti.

According to another aspect of the invention, there is provided a method of manufacturing a Ti alloy poppet valve, said method comprising the steps of:

introducing $O_2$ into a furnace to keep oxygen density less than stoichiometrical amount for forming titanium oxides in the furnace; and heating the valve for 1 to 4 hours at temperature of 700 to 840° C. to introduce oxygen atoms into titanium of the valve to form a Ti—O interstitial solid solution, thereby increasing wear resistance of the valve.

If the temperature is less than 700° C., oxygen is not sufficiently diffused into the Ti alloy valve, and required hardness is not obtained. If the temperature is more than 840° C., the poppet valve is deformed and is not actually employed as product. The range of 750 to 800° C. is preferable.

If the time is less than 1 hour, required hardness is not obtained, and if more than four hours, treating time is too long and productivity of the valve is decreased. The range of 2 to 3 hours is preferable.

The oxygen density to a surface area of the valve may be preferably $1.10\times10^{-7}$ g/cm$^2$ to $1.47\times10^{-6}$ g/cm$^2$. If it is less than $1.10\times10^{-7}$ g/cm$^2$, hardness is not sufficient, and if it is more than $1.47\times10^{-6}$ g/cm$^2$, oxygen is combined with Ti to form titanium oxide.

By the poppet valve manufactured by the present invention, wear resistance and durability are increased.

BRIEF DESCRIPTION OF THE DRAWINGS

The features and advantages of the invention will become more apparent from the following description with respect to embodiments as illustrated in appended drawings wherein.

DETAILED DESCRIPTION OF PREFERRED EMBODIMENTS

Figure 1:
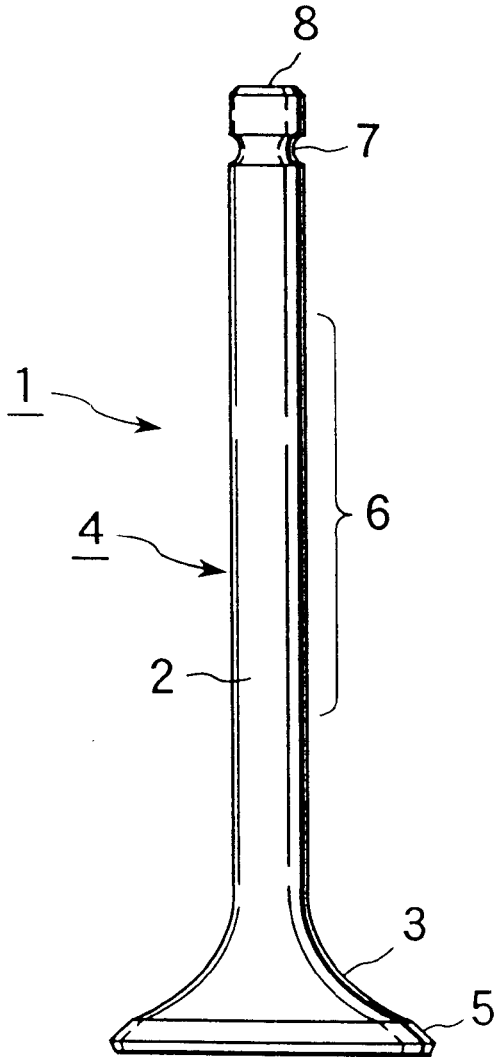
FIG. 1 is a front elevational view of a poppet valve.

FIG. 1 illustrates a Ti alloy poppet valve 1. A valve body 4 consists of a valve stem 2 and a valve head 3, and is made of Ti—6Al—4V of α-β alloy. It may be made of an α alloy such as Ti—5Al—2.5Sn, Ti—6Al—6V—2Sn and Ti—6Al—2Sn—4Zr—6Mo; a near α alloy which is an α-β alloy which contains β phase of less than 10% such as Ti—6Al—2Sn—4Zr—2Mo and Ti—8Al—1Mo—1V; or a β alloy such as Ti—13v—11Cr-3Al and Ti—15Mo—5Zr—3Al.

Surface treatment is carried out to harden wear-resistant portions of the valve body 4 such as a valve face 5, an engagement portion of the valve stem 2 which is engaged with a valve guide (not shown), a cotter groove 7 and a stem end face 8.

Figure 2:
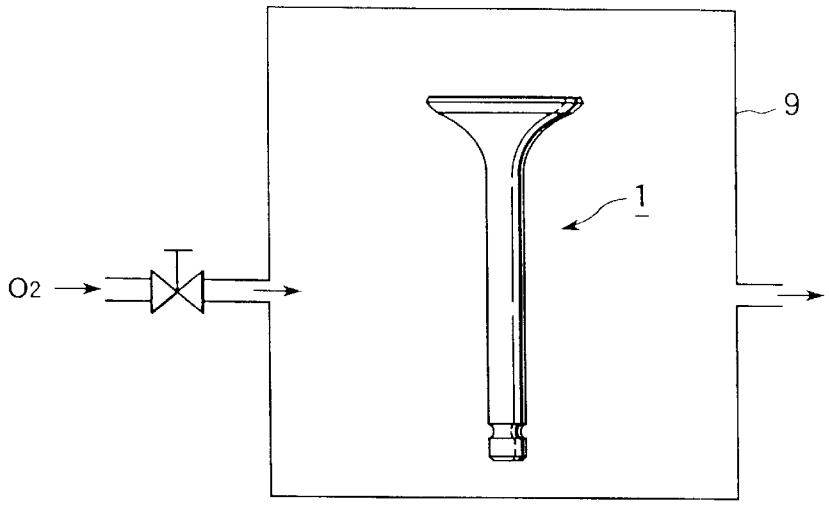
FIG. 2 is a schematic view which shows how to form an oxygen diffusion layer.

As illustrated in FIG. 2, the Ti alloy poppet valve 1 as above is put into a vacuum heating furnace 1, and oxygen density, time and temperature are defined to form an oxygen diffusion layer in the surface of the valve body 4. In Examples of the present invention and comparative examples, the oxygen density means an amount of oxygen with respect to a total surface area of the valve.

To avoid formation of titanium oxides, the oxygen density is set to a very small amount of less than stoichiometrical amount for forming titanium oxides.

The heating temperature is set to temperature less than 995° C., β transformation point of Ti—6Al—4V, thereby preventing decrease in toughness by formation of needle-like crystals of Ti alloy.

EXAMPLE 1

A poppet valve was heated in atmosphere of oxygen density of $1.10\times10^{-7}$ g/cm$^2$ at temperature of 750° C. for four hours, and cooled to room temperature by a nitrogen gas. With respect to the valve thus manufactured, hardness was good and deformation was small.

EXAMPLE 2

A poppet valve was heated in atmosphere of oxygen density of $2.83\times10^{-7}$ g/cm$^2$ at temperature of 800° C. for three hours, and compulsively cooled to room temperature by a nitrogen gas. With respect to the valve thus manufactured, hardness was good and deformation was small.

EXAMPLE 3

A poppet valve was heated in atmosphere of oxygen density of $1.42\times10^{-6}$ g/cm$^2$ at temperature of 700° C. for two hours, and compulsively cooled to room temperature by a nitrogen gas. With respect to the valve thus manufactured, hardness was good and deformation was small.

EXAMPLE 4

A poppet valve was heated in atmosphere of oxygen density of $1.47\times10^{-6}$ g/cm$^2$ at temperature of 800° C. for three hours, and compulsively cooled to room temperature by a nitrogen gas. With respect to the valve thus manufactured, hardness was good and deformation was small.

Comparative examples are as below:

Comparative Example 1

A poppet valve was heated in atmosphere of oxygen density of $1.08\times10^{-7}$ g/cm$^2$ at temperature of 700° C. for two hours, and compulsively cooled to room temperature by a nitrogen gas. With respect to the valve thus manufactured, deformation was small, but hardness was not good.

Comparative Example 2

A poppet valve was heated in atmosphere of oxygen density of $1.50\times10^{-6}$ g/cm$^2$ at temperature of 800° C. for three hours, and compulsively cooled to room temperature by a nitrogen gas. Deformation was small, but the oxygen density was too high, so that O reacted with Ti to form oxide film such as $TiO_2$ on the valve surface, thereby decreasing hardness.

Comparative Example 3

A poppet valve was heated in atmosphere of oxygen density of $1.40\times10^{-7}$ g/cm$^2$ at temperature of 850° C. for two hours, and compulsively cooled to room temperature by a nitrogen gas. Owing to high temperature, deformation of the valve is too large, so that the valve was not suitable for actual use.

Figure 3:
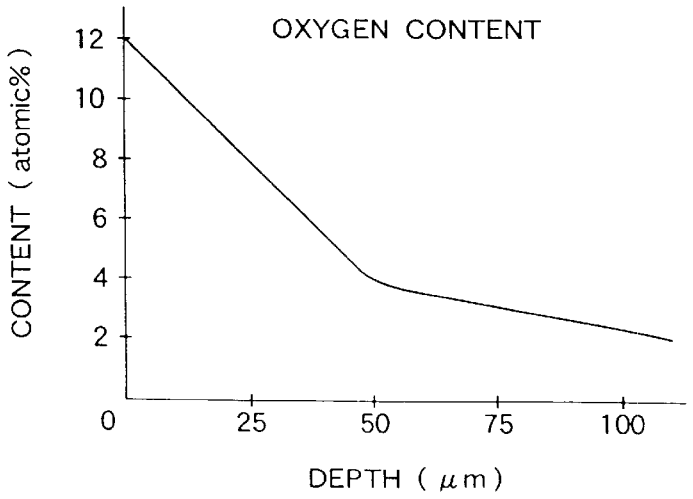
FIG. 3 is a graph which shows oxygen content with respect to depth from the surface of the valve after oxygen diffusion.

FIG. 3 illustrates an average of oxygen content measured at each depth in the examples 1 to 4 by a field emission Auger electron spectroscopy device. Depth from the surface of the poppet valve is taken on the axis of abscissas and oxygen density is taken on the axis of ordinates. The unit of oxygen content "atomic %" stands for "ratio of the number of oxygen atoms to the number of analyzed total atoms".

Titanium oxides ware not found by X-ray diffractrometer, too. Thus, oxygen atoms were not combined with Ti, but still remained as atoms in Ti to form an interstitial solid solution.

Figure 6:
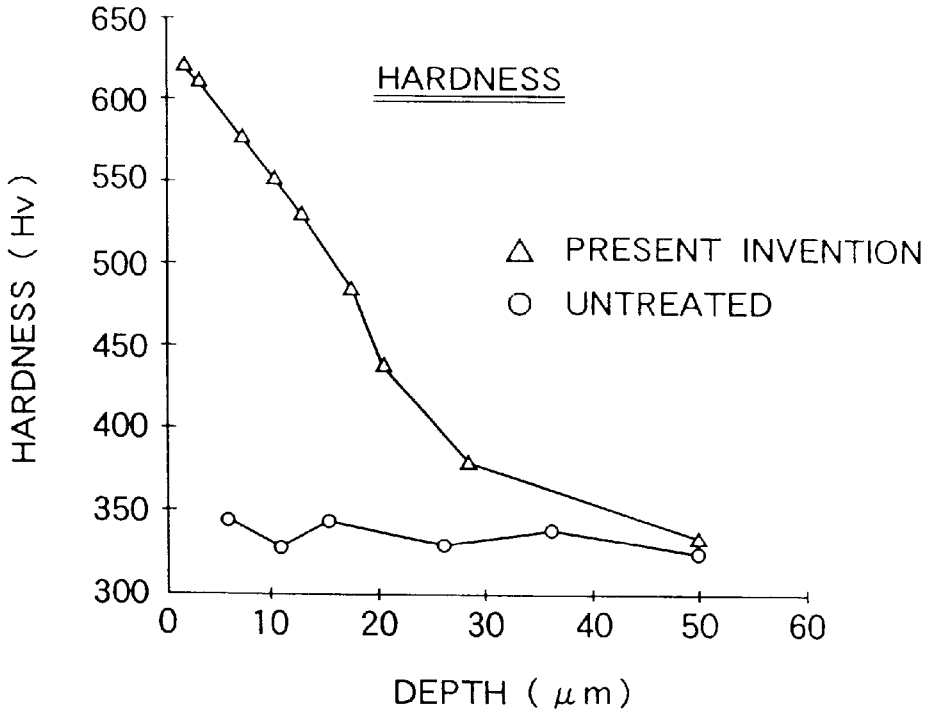
FIG. 6 is a graph which shows hardness of a valve after oxygen diffusion.

FIG. 6 illustrates a graph in which depth by μm is taken to the axis of abscissas, and hardness by Hv is taken to the axis of ordinates. An average of the Examples 1 to 4 of the present invention and one example of untreated valve are shown in the graph. They were determined by a Micro-Vickers hardness meter manufactured by Shimazu Corporation, a Japanese corporation.

As shown in the graph, hardness had about Hv 350 by the depth of 50 μm, and the valves treated by the invention had hardness of about Hv 500 to 630, which is significantly high hardness.

By depth of about 50 μm of a poppet valve used in an internal combustion engine, suitable wear resistance and hardness are required. From FIG. 3, if oxygen content is kept from 4 to 12% by depth of about 50 μm, sufficient wear resistance and hardness will be achieved.

If oxygen content in the surface exceeds 12%, hardness increases, but becomes fragile. So it is preferable to set the value to the upper limit.

It will be described as below to treat the surface of a valve body by introducing oxygen and carbon atoms into titanium of a valve.

A Ti alloy valve which consists of a valve stem and a valve head is put in a plasma vacuum furnace which contains oxygen less than stoichiometrical amount for forming titanium oxides, and a carburizing gas is introduced at temperature less than β transformation point of Ti alloy for a predetermined time. So oxygen and carbon atoms are introduced into the surface of the valve to form interstitial solid solution of O and C in Ti alloy to harden the surface of the valve.

EXAMPLE 5

Figure 4:
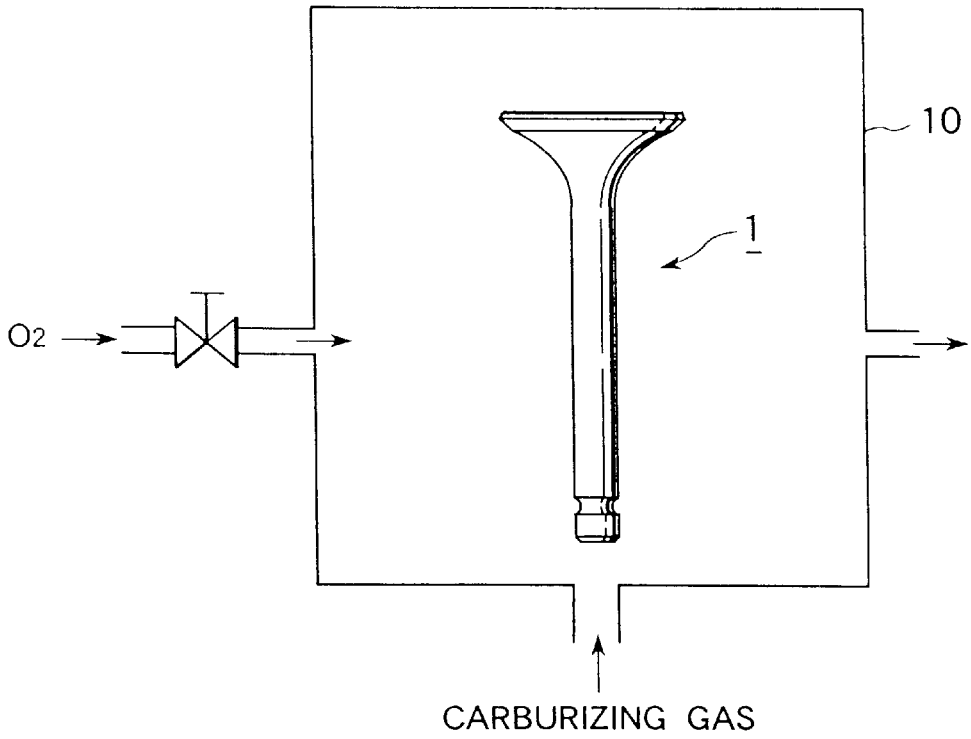
FIG. 4 is a schematic view which shows how to form oxygen and carbon diffusion layer.

Ti—6Al—4V alloy was thermally forged to form a valve body, which was put into a plasma vacuum furnace as shown in FIG. 4. An oxygen gas was introduced into the furnace, and oxygen density to the surface area of the valve was kept in $1.83\times10^{-7}$ cm$^2$. The valve was heated at 800° C. for three hours.

Then, a propane gas was introduced, and glow discharge was carried out in the furnace to introduce carbon atoms into the Ti alloy valve for carburizing. With respect to the valve thus manufactured, hardness was good and deformation was small.

Figure 5:
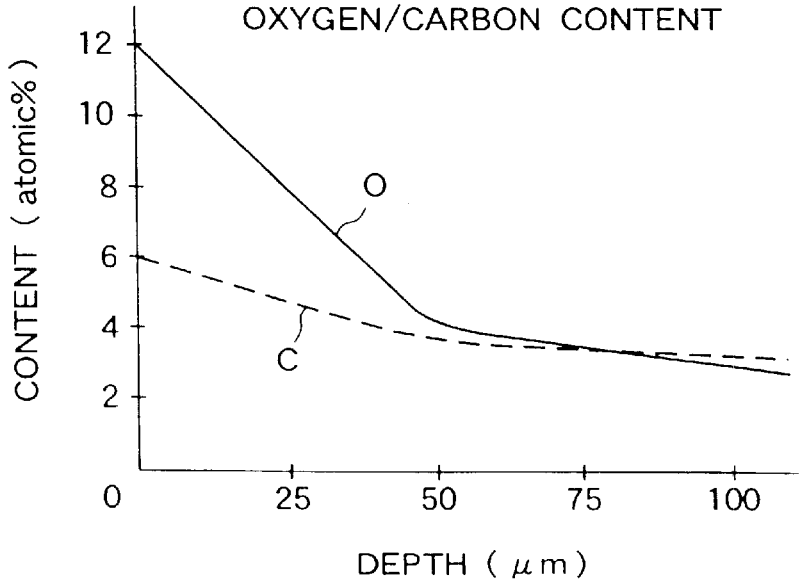
FIG. 5 is a graph which shows oxygen and carbon contents with respect to depth from the surface of the valve after oxygen diffusion and carburizing.
Figure 7:
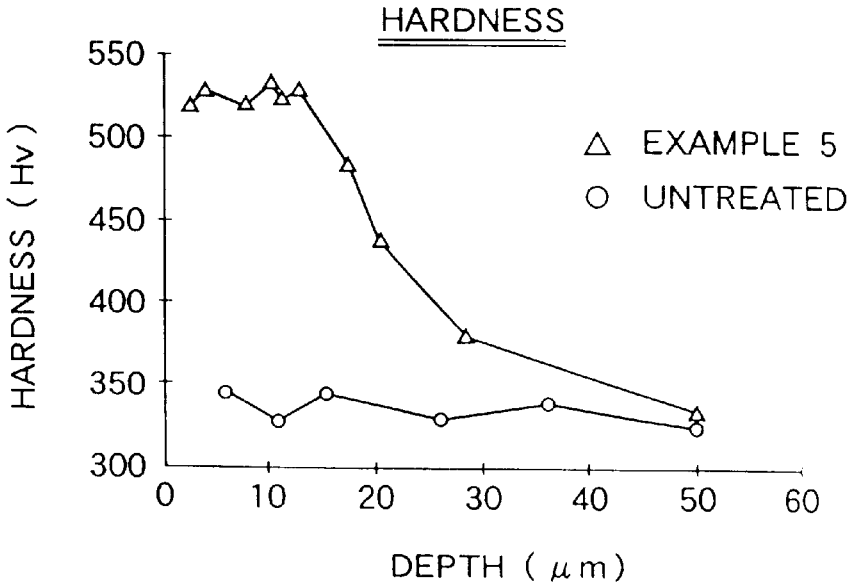
FIG. 7 is a graph which shows hardness of a valve after oxygen diffusion and carburizing.

FIG. 5 illustrates relationship of oxygen and carbon contents of the valve thus obtained to depth, and FIG. 7 illustrates relationship of hardness to depth.

According to X-ray diffraction by an X-ray diffractrometer, TiC was found in the valve body, but titanium oxide was not found. From FIG. 5, oxygen atoms were not combined with titanium, but remains as atoms in Ti. Carbon atoms were patially combined with titanium to form TiC, but the remaining were introduced to Ti as atoms.

In FIG. 7, the valve in Example 5 is higher in hardness than an untreated valve made of the same material, Especially hardness by depth of 15 μm was about Hv 530. Decrease in attackness to others and increase in wear resistance were both achieved.

Comparing FIG. 6 with FIG. 7, hardness near the surface in FIG. 7 was lower than that in FIG. 5. If carburizing is carried out in addition to oxygen diffusion, hardness is not so high, thereby decreasing attacking to others.

The inventors carried out an abrasion test with respect to pieces having oxygen diffusion layer, oxygen and carbon diffusion layers in Ti—6Al—4V alloy and Ti—6Al—2Sn—4Zr—2Mo alloy.

An abrasion tester and way to use it will be described as below.

Figure 8:
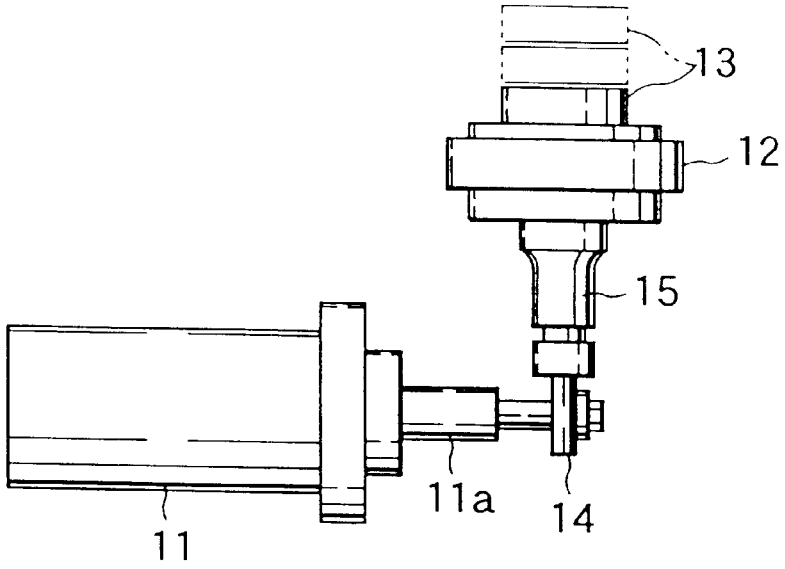
FIG. 8 is a front elevational view which shows an abrasion tester and how to test thereby.
Figure 10:
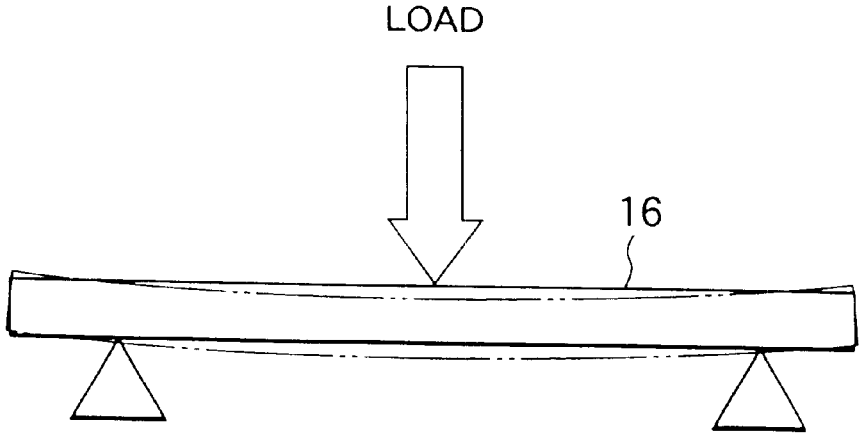
FIG. 10 is a front elevational view which shows a bending tester.

FIG. 8 illustrates a crossbar abrasion tester which comprises a horizontal motor 11, a fixing jig 12 which is mounted to the end of a shaft 11*a* to move vertically to fix a test piece, and a weight 13 on the fixing jig 12.

A disc-like chip made of steel such as forged metal is ground to make smooth outer circumferential surface, degreased, and is concentrically mounted to the end of the shaft 11*a*. Then, a degreased test piece 15 which has a smooth lower surface is mounted to the lower surface of the fixing jig 12, and the lower surface is engaged on the upper surface of the chip 14. A weight 12 of 1 kg is put on the upper surface of the fixing jig 11, and the motor 11 is actuated to rotate the chip 14 at a fixed speed. The weight 13 is added by 500 g every time the chip 14 and the piece 15 move by 50 m which is detected by the number of rotation of the motor and external diameter of the chip.

The test is finished when seizure or galling occurs between the test piece 15 and the chip 14 or when it slides by 350 m.

Figure 9:
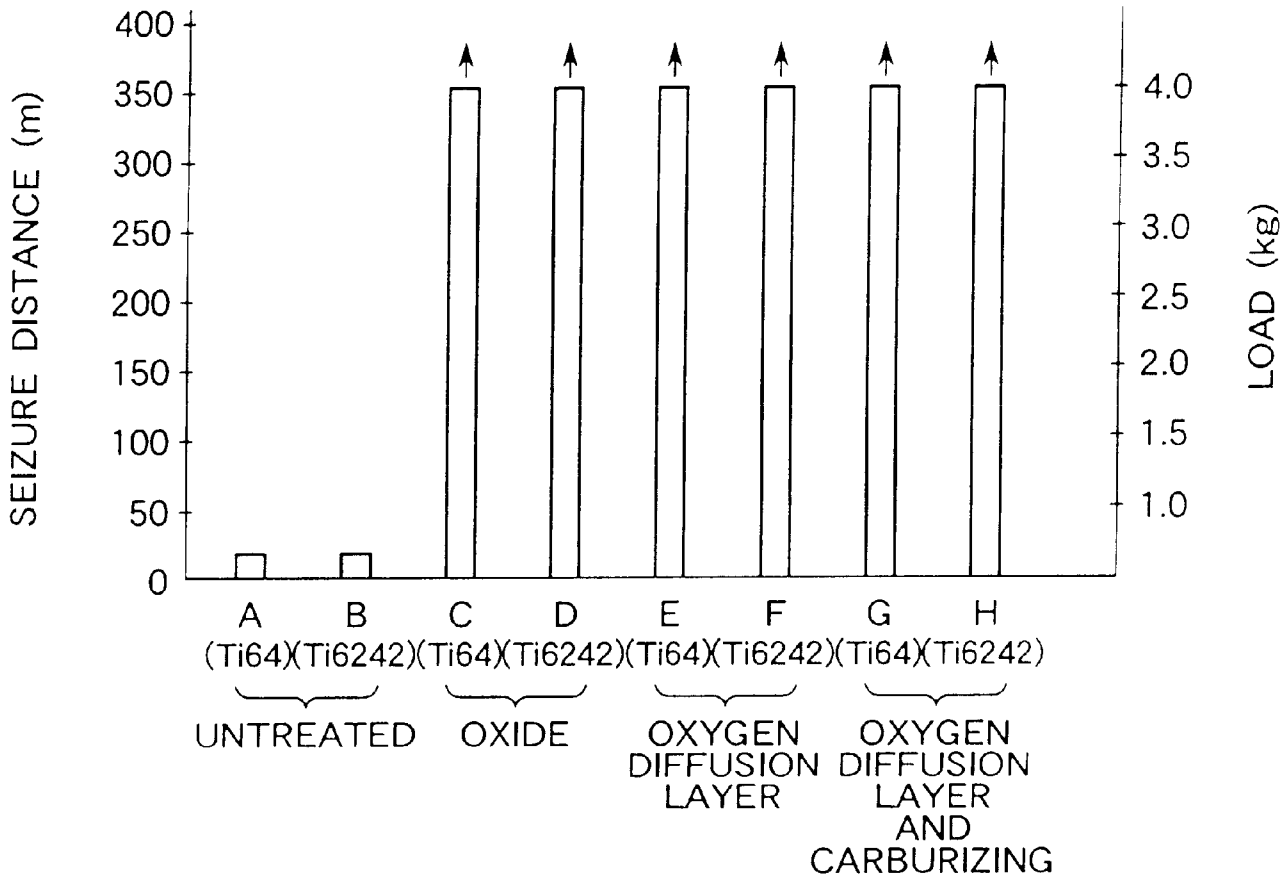
FIG. 9 is a graph which shows test results of test pieces by the abrasion tester.

FIG. 9 shows the results obtained by the above test.

In FIG. 9, (A) and (B) are Ti—6Al—4V and Ti—6Al—2Sn—4Zr—2Mo to which surface treatment was not applied, respectively; (C) and (D) are the two alloys to which oxidation was applied; (E) and (F) are the two alloys to which oxygen diffusion layer was contained; and (G) and (H) are the two alloys to which oxygen and carbon diffusion layers are applied.

As shown in FIG. 9, seizure distance significantly increased in the test tests (E) to (H) to which the present invention was applied compared with (A) and (B) to which surface treatment was not applied. Similar to (C) and (D) to which oxidation was applied, even if they slides by 350 m, no seizure occurred to find significantly-high wear resistance. It will be clear that the poppet valve has significantly increased wear resistance.

By the inventors, test pieces 16 having diameter of 6 mm were prepared and the above treatment was made to the pieces. Load was applied to the middle while the ends were supported, and the pieces were bent by about 1 mm. The condition of the surface layer was inspected.

In the test piece to which oxidation was applied, detachment occurred on the surface layer. In the test piece to which oxygen diffusion was applied, cracking occurred on the surface layer, and in the test piece to which oxygen diffusion and carburizing were applied, no abnormality occurred.

Considering the results, as to the test piece to which oxidation was applied, hard fragile oxide formed on the surface layer is detached. As to the test piece to which oxygen diffusion layer was only applied, cracking occurred as a result of too high hardness on the surface layer, and as to the test piece to which oxygen diffusion and carburizing were applied, advantage owing to slight decrease in hardness of the surface layer was achieved.

The present invention may be also applied to a Ti—Al intermetalic compound.

The foregoing merely relate to embodiments of the invention. Various modifications and changes may be made by person skilled in the art without departing from the scope of claims wherein:

What is claimed is:

1. A method of manufacturing a Ti alloy poppet valve, said method comprising the steps of:

introducing $O_2$ into a furnace to keep oxygen density less than stoichiometrical amount for forming titanium oxides in the furnace; and heating the valve for 1 to 4 hours at temperature of 700 to 840° C. to introduce oxygen atoms into titanium of the valve to form Ti—O interstitial solid solution, thereby increasing wear resistance of the valve.

2. A method as claimed in claim 1 wherein said oxygen density to a whole surface area of the valve is $1.10\times10^{-7}$ g/cm$^2$ to $1.47\times10^{-6}$ g/cm$^2$.

3. A method as claimed in claim 1 wherein the heating step is carried out at temperature is 750 to 800° C.

4. A method as claimed in claim 1 wherein the heating step is carried out for 2 to 3 hours.

5. A method as claimed in claim 1 wherein said furnace comprises a vacuum heating furnace.

6. A method as claimed in claim 1 wherein said furnace comprises a plasma vacuum furnace into which a carburizing gas is put to introduce carbon atoms into titanium of the valve.

7. A method as claimed in claim 1 wherein said poppet valve is made of α-β Ti alloy.

8. A Ti alloy poppet valve as claimed in claim 7 wherein said α-β Ti alloy is Ti—6Al—4V.

* * * * *

UNITED STATES PATENT AND TRADEMARK OFFICE

CERTIFICATE OF CORRECTION

PATENT NO. : 6,623,568 B2
DATED : September 23, 2003
INVENTOR(S) : Masahito Hirose and Hiroaki Asanuma It is certified that error appears in the above-identified patent and that said Letters Patent is hereby corrected as shown below:

Column 6,
Line 47, delete "Ti alloy poppet valve", and insert -- method --.

Signed and Sealed this

Sixth Day of April, 2004

JON W. DUDAS
*Acting Director of the United States Patent and Trademark Office*